US007952597B2

(12) United States Patent
Kubota et al.

(10) Patent No.: US 7,952,597 B2
(45) Date of Patent: May 31, 2011

(54) IMAGE DISPLAY DEVICE

(75) Inventors: Hidenao Kubota, Yokohama (JP); Tomoyuki Kawamura, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 959 days.

(21) Appl. No.: 11/296,291

(22) Filed: Dec. 8, 2005

(65) Prior Publication Data

US 2006/0125849 A1 Jun. 15, 2006

(30) Foreign Application Priority Data

Dec. 9, 2004 (JP) ..... 2004-356158

(51) Int. Cl.
*G09G 5/10* (2006.01)

(52) U.S. Cl. ..... 345/690

(58) Field of Classification Search ..... 345/690; 315/169.4

See application file for complete search history.

(56) References Cited

U.S. PATENT DOCUMENTS 6,008,842 A * 12/1999 Nagata ..... 348/173
6,288,715 B1 * 9/2001 Bain et al. ..... 345/211
6,313,878 B1 * 11/2001 Jankowiak ..... 348/377
6,661,428 B1 * 12/2003 Kim ..... 345/690
6,856,328 B2 * 2/2005 Holtslag ..... 345/690
7,199,840 B2 * 4/2007 Shiota ..... 348/678
2001/0030513 A1 * 10/2001 Takada et al. ..... 315/169.4
2003/0090488 A1 * 5/2003 Yoo ..... 345/473

FOREIGN PATENT DOCUMENTS

JP 5-344371 12/1993
JP 2000-227775 8/2000
JP 2001-175212 6/2001
JP 2002-351442 12/2002
JP 2002351442 A * 12/2002
JP 2003-295827 10/2003

OTHER PUBLICATIONS

Office Action in JP 2004-356158, dated Sep. 7, 2010. (in Japanese) (2 pgs).

* cited by examiner

*Primary Examiner* — Richard Hjerpe
*Assistant Examiner* — Carolyn R Edwards
(74) *Attorney, Agent, or Firm* — Antonelli, Terry, Stout & Kraus, LLP.

(57) ABSTRACT

There is provided an image display device which can control image retention-preventing means in a static image displaying part, according to a change with the passage of time in a luminance difference. The drive of the image retention-preventing means is cancelled when accumulated elapsed-time during which the luminance difference is returned to approximately an original value elapses.

9 Claims, 6 Drawing Sheets

IMAGE DISPLAY DEVICE

CLAIM OF PRIORITY

The present application claims priority from Japanese application serial no. JP 2004-356158, filed on Dec. 9, 2004, the content of which is hereby incorporated by reference into this application.

FIELD OF THE INVENTION

The present invention relates to an image display device for displaying images and, more particularly, to a technology for preventing image retention that is produced, for example, when a static image is displayed by an image display device making use of the light emission of a phosphor.

BACKGROUND OF THE INVENTION

Recently, a plasma display panel (hereinafter abbreviated to "PDP") display device that utilizes the light emission of the phosphor excited by the ultra-violet ray has been commercially available. Moreover, as a thin flat-type image display device that utilizes the light emission of the excited phosphor, there is also, for example, the FED (Field Emission Display) which utilizes the light emission of the excited phosphor induced by irradiating, with the electron beam, the phosphor from the cold cathode electron source in which a large number of electron emitting elements are arranged in a matrix manner (two dimensionally).

Generally, not only the PDP display device but also all image display devices utilizing the light emission of the phosphor has the problem as follows. That is, if the static image with a high luminance level is displayed for a long time, the phosphor is degraded, and consequently, the difference in luminance (luminance difference) is caused between that part and other parts, that is, a so-called image retention occurs.

For the prevention of the image retention, there is a process as disclosed in JP-A No. Hei 5-344371, in which the displayed image remains unchanged for a predetermined time or longer, the image is regarded as a static image, and the luminance level of the entire display screen is lowered.

Moreover, JP-A No. 2000-227775 discloses a method in which when a static image is disclosed on the screen for a predetermined time or longer, the entire screen is moved by several dots to an almost imperceptible extent.

Furthermore, JP-A No. 2002-351442 discloses a method in which, in the case where both the moving image and the static image are displayed on the screen, the static image part is distinguished from the entire screen, and when the static image part remains unchanged for a predetermined time or longer, the luminance level only in the static image part is lowered.

SUMMARY OF THE INVENTION

Inherently, the light-emitting efficiency of the PDP display device is not so high as that of the CRT. Therefore, the number of discharge pulses is increased to increase the peak luminance, and thereby achieving the high luminance. For this reason, image retention is more liable to occur in the PDP display device than in the CRT. Moreover, when comparing the FED with the CRT, the accelerating voltage is 10 KV or smaller and the current density is large in the FED, and thus, the phosphor of the FED is ease to be degraded. Therefore, like the PDP display device, the image retention frequently occurs in the FED. That is, image retention-preventing means is becoming important in the PDP display device, the FED and the like.

The techniques disclosed in JP-A No. Hei 5-344371, JP-A No. 2000-227775, and JP-A No. 2002-351442 are directed to the method in which the static image is detected and the luminance difference (image retention) is prevented from occurring. However, it is not disclosed in them at all that, as accumulated time elapsing during lightning of the PDP after initial lightning of the PDP (hereinafter referred to as "accumulated elapsed-time") is increased, the luminance difference of the static image displaying part is decreased as compared to that of the moving displaying part. The inventors of the present invention exerted their ingenuities and, consequently, found the above fact. Incidentally, the details of the discovery of the fact will be discussed hereinafter.

The image retention-preventing means, described in JP-A No. Hei 5-344371, JP-A No. 2000-227775, and JP-A No. 2002-351442, is actuated even if the accumulated elapsed-time is increased, so that the image retention-preventing means is idly actuated.

An object of the present invention is therefore to provide an image display device capable of displaying images that do not cause the user to have any uncomfortable feeling, by improving the image retention preventing means, for example.

Now, the details of the discovery of the above-mentioned fact will be discussed. FIG. 2 illustrates an example of the image signal data containing static images with high luminance, which are mixed in the moving image transmitted from a TV station. The static images in FIG. 2 includes, for example, a time clock display 201, a broadcasting station logo display 202, and other information displays 203, 204 such as the index of a TV program (hereinafter, these are generally referred to as telop for the sake of convenience). These static images are generally high in their luminance levels and remain displayed for a long time. It is known that the phosphors of the display parts displaying the static images are consequently degraded more as compared to that of the display part displaying the moving image.

FIG. 7 is a diagram exhibiting the degradation rate of the phosphor in the static image displaying part relative to the moving image displaying part, namely, a measured change with the passage of time in a luminance difference. The measurement of the change in the luminance difference was carried out as follows. That is, as shown in FIG. 6, a window white signal was continued to be displayed at a display rate of 1% (a signal level is, for example, 60% white in which a luminance level of the telop display had been lowered by luminance correction) in a moving image 302 as a static image display 301 on the assumption of the telops such as the time clock and the like.

Then, the accumulated elapsed-time was taken as the horizontal axis, and the luminance of the part that had been the moving image and the luminance of the window part were measured. At the time of the measurement, the image of the entire white signal was displayed in the static image displaying parts and the moving image displaying part, and a difference in luminance (luminance difference) between the image and the static image displays 301 was found.

In FIG. 7, the horizontal axis represents the accumulated elapsed-time and the vertical axis represents the luminance difference between the part that was the moving image, and the window part. As shown in FIG. 7, as the accumulated elapsed-time passes, the luminance difference spreads until a certain accumulated elapsed-time A, and the extent of the image retention becomes bad. However, the investigation by the inventors of the present invention has newly revealed that, when the accumulated elapsed-time A passes, the luminance difference is gradually returned and, when a certain accumulated elapsed-time B elapses, the luminance difference is returned to an original value.

However, as described above, JP-A No. Hei 5-344371, JP-A No. 2000-227775, and JP-A No. 2002-351442 are directed to the methods in which the static images are detected and the luminance difference (image retention) is prevented from occurring. They do not disclose at all that, as the accumulated elapsed-time is increased, the luminance difference of the static image displaying parts is decreased as compared to that of the moving image displaying part (returning of luminance difference). For this reason, in the methods disclosed in them, it is necessary, for example, to lower the brightness of the entire screen (luminance) or lower the luminance of the static image part.

In order to solve the above-mentioned problems, in an image display device that displays images utilizing the light emission of phosphors, for example, as in an image display device set forth in claim 1, the image display device includes a control section which controls luminance due to the deterioration of the phosphors and may be constructed such that the control section stops the control of the luminance according to accumulated drive time of the image display device.

In accordance with the present invention, there is provided an image display device capable of displaying images that do not cause the user to have any uncomfortable feeling, by improving the image retention preventing means, for example.

DETAILED DESCRIPTION OF THE PREFERRED EMBODIMENTS

The present invention will be discussed hereinafter with reference to the accompanying drawings.

First Embodiment

Figure 1:
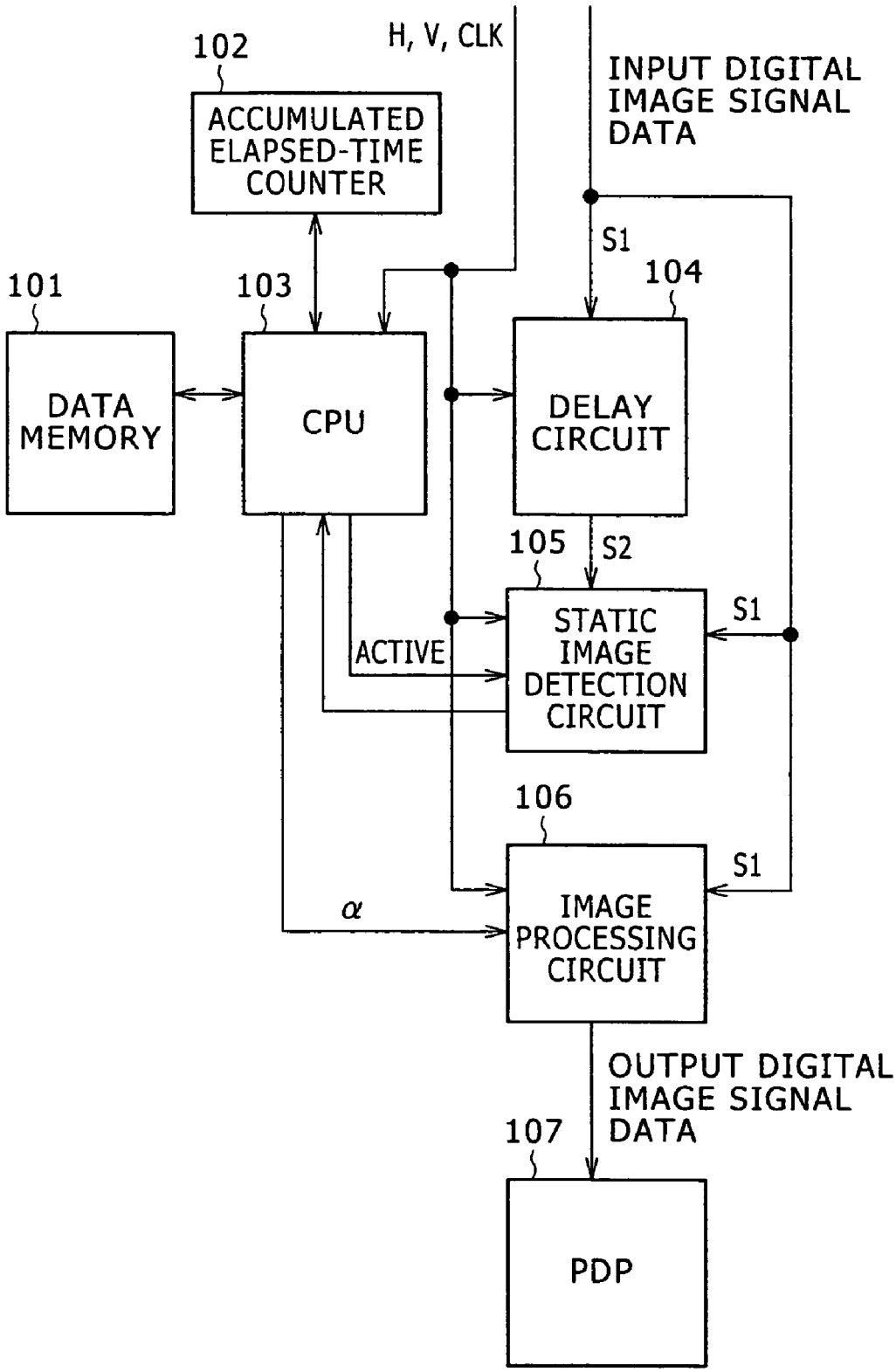
FIG. 1 a block diagram illustrating the structure of an image display device according to a first embodiment of the present invention.

First of all, a first embodiment according to the present invention will be discussed. Referring now to FIG. 1, there is illustrated a block diagram exhibiting the structure of an image display device according to the first embodiment of the present invention. Incidentally, as shown in FIG. 2, the image transmitted from the TV station shall contain the static images that are the telops and mixed in the moving image, and the telops shall be unevenly distributed in specific regions R201, R202, R203, R204 around the four corners of the display screen.

In FIG. 1, the reference numeral 101 denotes a data memory in which luminance correction data (discussed hereinafter), time TB corresponding to the accumulated elapsed-time B indicated in FIG. 4 (discussed hereinafter), and the like are stored, the reference numeral 102 denotes an accumulated elapsed-time counter for counting accumulated time elapsing during the displaying of the static images, the reference numeral 103 designates a system control unit (hereinafter abbreviated to "CPU") such as the microcomputer for controlling the entire system of the image display device, and the reference numeral 104 designates a delay circuit composed of a memory and the like and functioning to delay the digital image signal data S1, which is the inputted luminance signal, by one field (or by one frame). The reference numeral 105 denotes a static image detection circuit, in which the image level of the digital image signal data S1 and that of the inputted digital image signal data S2 delayed by one field (or by one frame) in the delay circuit 104 are compared, the presence of the static image is detected in each field (or each frame), and then, the detection result is outputted to the CPU 103, and the reference numeral 106 designates an image processing circuit in which the luminance level of the inputted digital image signal S1 is adjusted by using the luminance correction data α that is stored in the data memory 101 and outputted from the CPU 103 (namely, the image processing circuit 106 carries out reducing of image retention). The image processing circuit 106 is adapted to output the digital image signal data subjected to the luminance correction processing, that are then displayed by a PDP 107.

Figure 2:
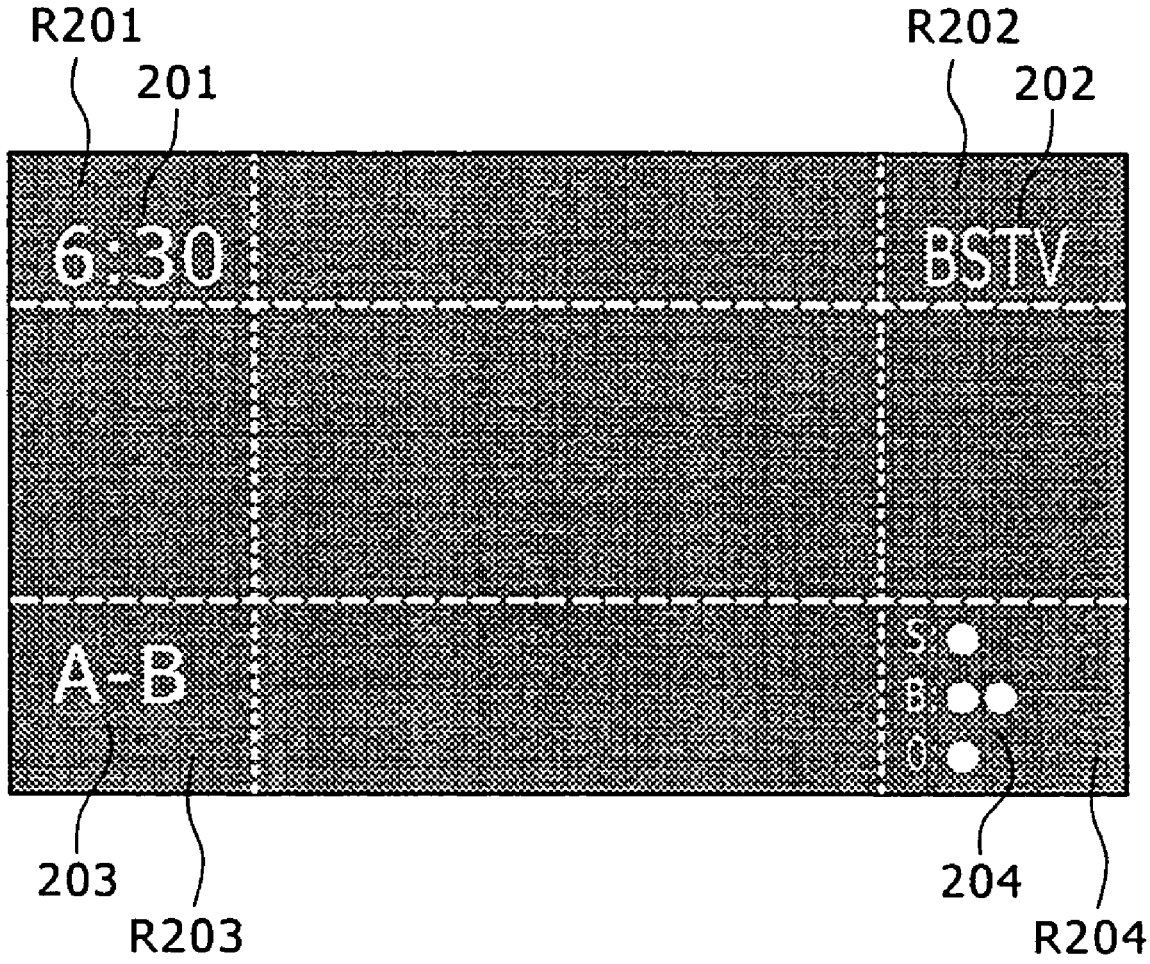
FIG. 2 is a diagram illustrating an example of the image signal data containing the static images which are mixed in a moving image transmitted from a TV station.

The CPU 103 can determine specific regions R201, R202, R203, and R204 in advance set around the four corners of the display screen like those shown as the telops including the time clock 201, the logo 202, and the information displays 203, 204 in FIG. 2 based on an inputted horizontal synchronization signal H, a vertical synchronization signal V, and a clock signal CLK. More particularly, the CPU 103 specifies the area in the horizontal direction by counting the clock signal CLK from the start of the horizontal synchronization signal H and also specifies the area in the vertical direction by counting the horizontal synchronization signal H on the basis of the start of the vertical synchronization signal V, thereby determining the specific regions. Then, the CPU 103 outputs the ACTIVE signal to the static image detection circuit 105, by which the static image detection operation in the specific regions by the static image detection circuit 105 is made active.

Next, the luminance correcting operation of FIG. 1 for reducing the image retention will be discussed. The inputted digital image signal data S1 is inputted to the static image detection circuit 105 and also to the delay circuit 104, and in the delay circuit 104, the digital image signal data S1 is delayed by one field (or by one frame) and inputted to the static image detection circuit 105 as the delayed digital image signal data S2.

In the static image detection circuit 105, the luminance level of the image signal data S1 and that of the delayed image signal data S2 are compared to detect the static image, and the detection result is outputted to the CPU 103.

The regions in which the static images are to be detected are the predetermined specific regions (R201 to R204) around the four corners of the display screen, and the CPU 103 can determine the range of the specific regions (R201 to R204) around the four corners of the display screen by the use of the horizontal synchronization signal H, the vertical synchronization signal V, and the clock signal CLK in the manner mentioned above. In addition to the horizontal synchronization signal H, the vertical synchronization signal V, and the clock signal CLK, the CPU 103 outputs the ACTIVE signal to the static image detection circuit 105, by which the static image detection operation in the specific regions is made active.

In these specific regions, the pixels remaining unchanged are judged to be the pixels of the static images, and thus, the static images can be detected. The digital image signal data to be compared at this time is limited to only the part of one of the digital image signal data S1 and S2 (e.g., the digital image signal data S2) having the luminance level higher than the predetermined level. By so doing, it is possible to positively detect the static pixels with high luminance level to be the cause of image retention regardless of the influence from the noise and the like. When the digital image signal is composed of, for example, 8-bit gradation, the predetermined level can be easily obtained by using the upper 4 bits. When the detection result that the static image is detected in the above-mentioned four specific regions is inputted from the static image detection circuit 105, the CPU outputs the luminance correction data stored in the data memory 101 to the image processing circuit 106 for adjusting the luminance level, then lowers the luminance level of the pixels within the specific regions around the corners, in which it is determined that the static images are displayed, and reduces the image retention. Then, the accumulated elapsed-time counter 102 continues the counting until the static image detection signal is stopped, and calculates the accumulated elapsed-time of static image displaying.

Next, the method of correcting the luminance level of the pixels within the specific regions will be discussed. The luminance correction data for correcting the luminance of the digital image signal S1 inputted to the image processing circuit 106 is stored in advance in the data memory 101. In this embodiment, this luminance correction data is the luminance weighting factor $\alpha$ ($\leqq 1$) to be multiplied by the luminance of the digital image signal S1, and the image processing circuit 106 multiplies the luminance of the inputted digital image signal S1 by the luminance weighting factor $\alpha$ inputted from the CPU 103 to adjust the luminance.

Figure 3A:
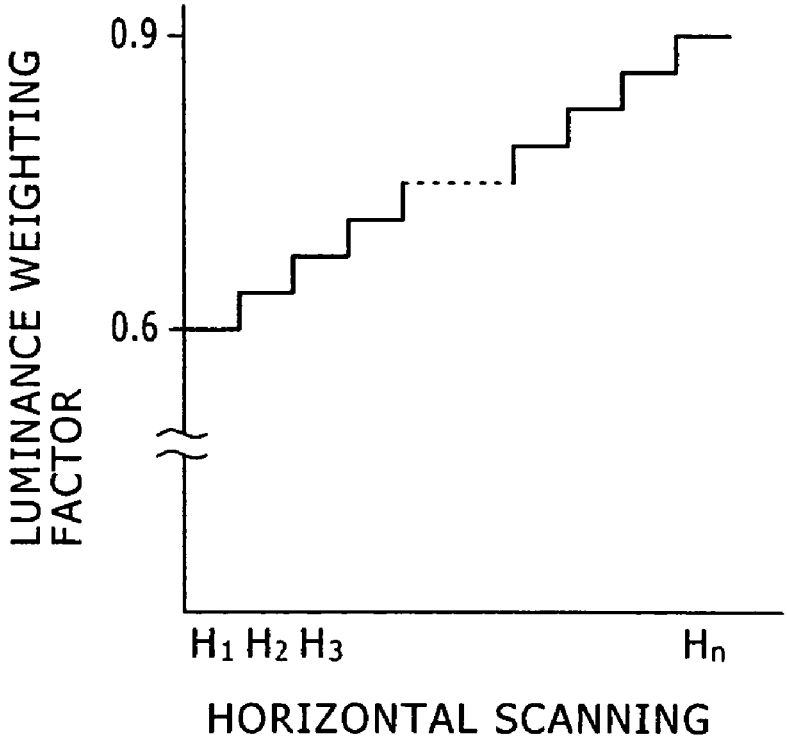
FIGS. 3A and 3B are schematic diagrams for explaining a luminance weighting factor α that is the luminance correction data stored in advance in a data memory.
Figure 3B:
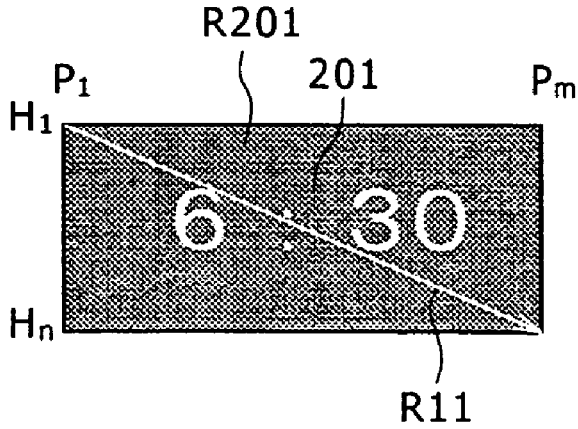

FIGS. 3A and 3B are schematic diagrams for explaining the luminance weighting factor $\alpha$ that is the luminance correction data stored in advance in the data memory 101. For the simplification of the description, the description will be made with taking the specific region R201 in FIG. 2 as an example, in which the time clock 201 serving as the static image is present. As shown in FIG. 3B, this specific region R201 is represented by the area in which there are the pixels P1 to Pm arranged along the horizontal direction and the horizontal synchronization signals H1 to Hn are arranged along the vertical direction. In such a situation, when the luminance of the specific region R201 with the static image (time clock 201) is lowered in order to prevent the image retention, the luminance level of the specific region R201 is lowered more largely toward the corner of the outer edge of the display screen region. FIG. 3A shows the luminance weighting factor $\alpha$ along the direction of the arrow R11 in FIG. 3B. In FIG. 3A, the luminance weighting factor $\alpha$ of the pixel Pm close to the center of the display screen region is 0.9 and the luminance weighting factor $\alpha$ of the pixel P1 close to the corner is 0.6. The luminance inclination there between is linearly changed.

As described above, since the luminance weighting factor $\alpha$ to be the luminance correction data capable of lowering the luminance level more largely toward the outer edge is stored in the data memory 101, the luminance level of the pixels in the specific region R201 around the corner is lowered more largely toward the outer edges. Therefore, the watcher does not have any uncomfortable feeling. In addition, even if the pixels around the border between the moving image and the static image are not determined to be the pixels of the static image due to the influence from the noise or the like, since the luminance level of all pixels in the specific region R201 is lowered, there is no possibility that remarkable deterioration of the phosphor will occur. In addition, it is possible to prevent the problem that the luminance balance of the figures each representing the hour, the tens of minutes, and the minutes becomes ununiformed in the time clock 201.

As described above, the luminance difference that occurs due to the deterioration of the phosphor of the moving image displaying part and the deterioration of the phosphor of the static image displaying part can be made unnoticeable. However, the luminance difference of the static image displaying part relative to the moving image displaying part is not such that the luminance difference gradually spreads (or the luminance difference is saturated at a certain luminance difference) as traditionally supposed. As experimentally found by the inventors of the present invention and shown in FIG. 7, it has become clear that, when the bottom point of the luminance difference (accumulated elapsed-time A) elapses, the luminance difference gradually becomes small and is moderately returned, and when the certain accumulated elapsed-time B passes, the luminance difference is returned to an approximately original value. Moreover, it has also been experimentally found that when the luminance difference becomes approximately 2% or less, the luminance difference becomes visually unnoticeable. In other words, when the luminance difference becomes 2% or less, the operation for reducing the image retention may be terminated.

Therefore, when the accumulated elapsed-time of the static image displaying exceeds the point B or approaches the accumulated elapsed-time B (for example, 100 hours or less), it is favorable that the above-mentioned luminance correction process for reducing the image retention is stopped (cancellation of the process). By so doing, the watcher can take pleasure in looking at bright images over the entire display screen.

Figure 4:
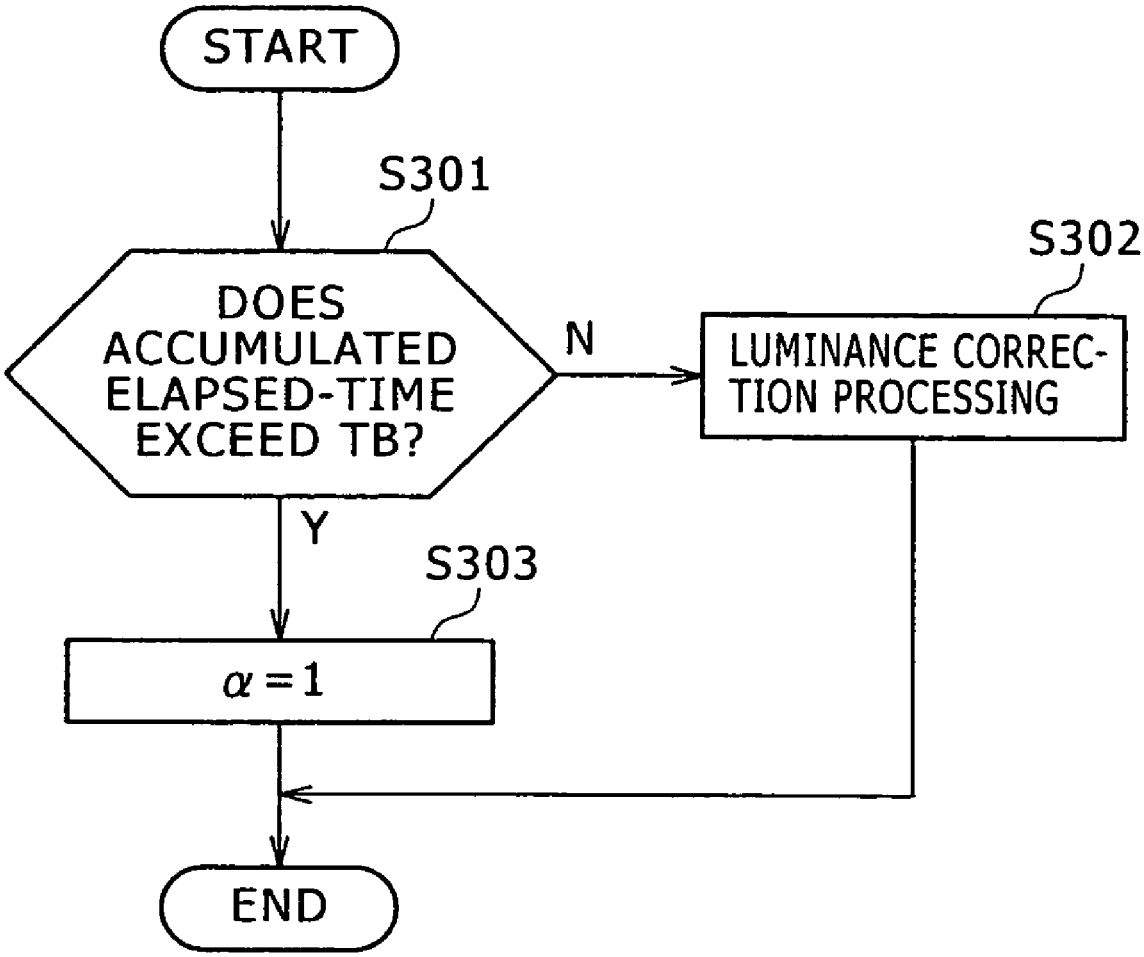
FIG. 4 is a block diagram showing an example of a luminance correction process to which a function for canceling the luminance correction process is applied.
Figure 7:
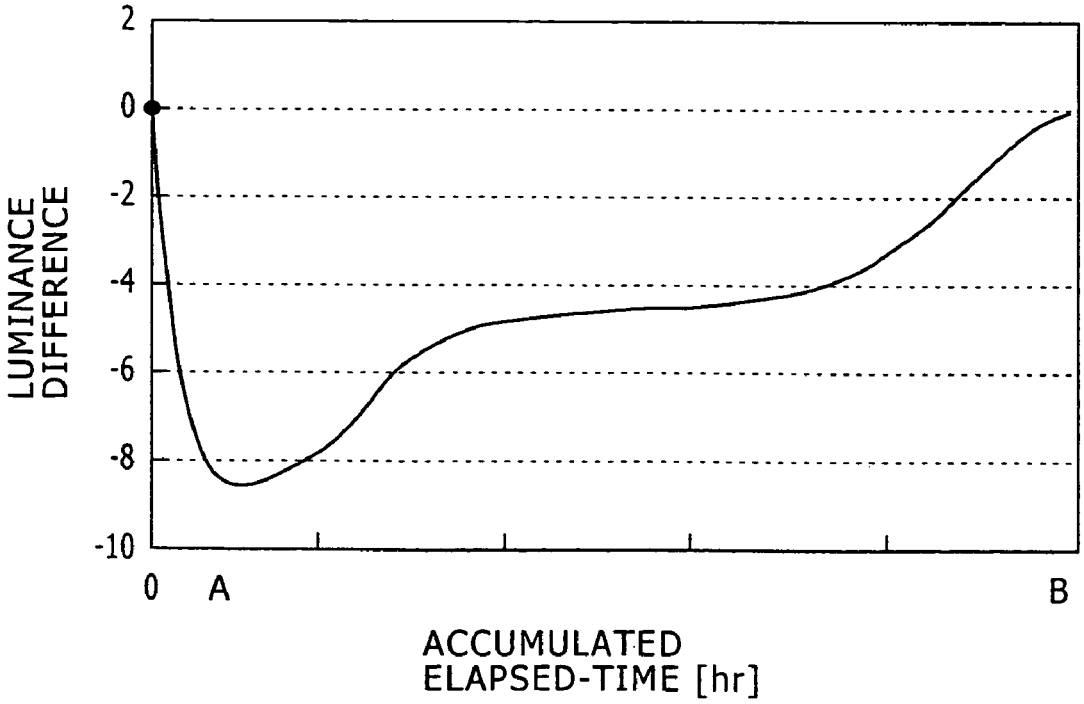
FIG. 7 is a diagram showing a change with the passage of time in luminance difference of static image displaying parts relative to a moving image displaying part.

Referring now to FIG. 4 that is a flowchart, the luminance correction process to which a function for canceling the luminance correction process is applied when the accumulated elapsed-time of the static image displaying exceeds the accumulated elapsed-time TB corresponding to the accumulated elapsed-time B in FIG. 7, will be discussed hereinafter. Incidentally, the accumulated elapsed-time TB that corresponds to the accumulated elapsed-time B shall be experimentally obtained in advance by the PDP to be used in the luminance correction process, and stored in advance in the data memory 101.

When the static image display is detected in the static image detection circuit 105, the CPU 103 judges at step 301 (step is abbreviated to "S", hereinafter) in FIG. 4 whether or not the accumulated elapsed-time of the static image displaying that is indicated by the accumulated elapsed-time counter 102 exceeds the accumulated elapsed-time TB. If the accumulated elapsed-time of the static image displaying does not exceed the accumulated elapsed-time TB, the CPU 103 causes the image processing circuit 106 to carry out the luminance correction processing at step S302 and the operation is then terminated. Conversely, if the accumulated elapsed-time of the static image displaying exceeds the accumulated elapsed-time TB, the image processing circuit 106 is operatively set by the CPU at step S303 so as not to carry out the luminance correction processing (that is, the luminance weighting factor is set as $\alpha=1$), and the operation is then terminated.

While the luminance weighting factor is set as $\alpha=1$ at S303 in the procedure of FIG. 4, the luminance weighting factor is not limited to the value. For example, the luminance inclination may be made small as discussed above with reference to FIG. 3A (that is, the luminance weighting factor of the pixel P1 close the corner of the display screen is made large and the inclination of the luminance weighting factor formed of the luminance weighting factor of the pixel P1 and the luminance factor of the pixel Pm close the center of the display screen is made small).

Moreover, while whether or not the accumulated elapsed-time of the static image displaying exceeds the accumulated elapsed-time is judged at step S301, the processing at step S301 is not limited to this. It is needless to say that, for example, when the accumulated elapsed-time of the static image displaying comes close to the accumulated elapsed-time TB (for example, less than 100 hours), the processing at step S303 may be carried out. Thus, there is no possibility that the luminance difference will be made remarkable.

In the foregoing, the case where the luminance difference due to the deterioration of the phosphors in the specific regions around the four corners of the display screen on which the telops are displayed has been described. However, the present invention is not limited to this. It is needless to say that the present invention can be applied to an image display device that is provided with means for detecting static image displaying regions and preventing the image retention of at least the regions (for example, luminance correcting means for reducing the luminance). Furthermore, it is clear that the means for preventing the image retention includes the technique disclosed in, for example, JP-A No. 2002-351442.

Second Embodiment

Next, a second embodiment according to the present invention will be discussed.

In the first embodiment of the present invention, the accumulated elapsed-time of the static image displaying is counted. However, as the TV broadcasting is digitalized in the future (for example, digital terrestrial broadcasting and BS digital broadcasting), for example, a logo mark representing a service provider and like may be almost always displayed on a part of the display screen (for example, upper right corner). In this case, accumulated drive-time of the display device (for example, PDP, FED and the like) can be substituted for the accumulated elapsed-time of the static image displaying that is discussed above.

Figure 5:
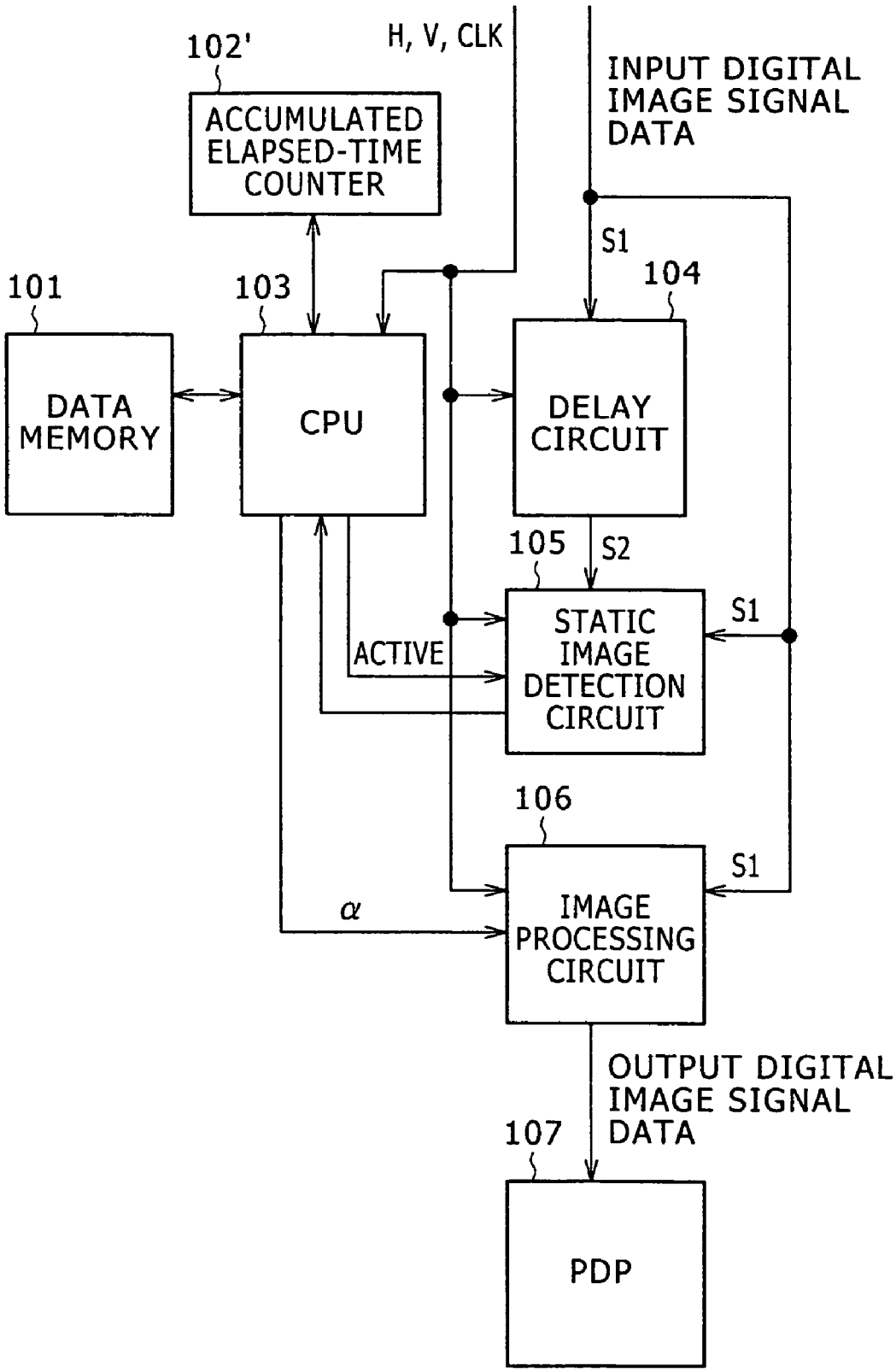
FIG. 5 is a block diagram illustrating the structure of an image display device according to a second embodiment of the present invention.
Figure 6:
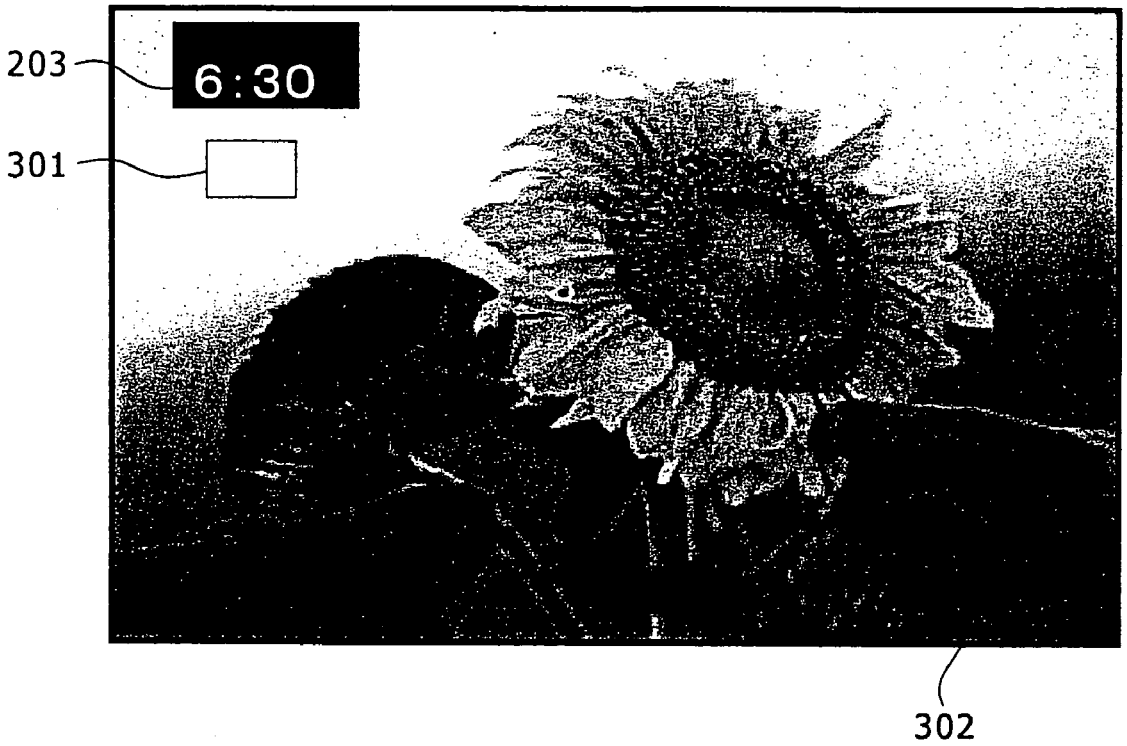
FIG. 6 is a view exhibiting an image that is of assistance in explaining quantum evaluation of image signal data containing static images that are mixed in a moving image transmitted from a TV station.

FIG. 5 is a block diagram exhibiting the structure of the image display device according to the second embodiment of the present invention. Incidentally, in FIG. 5, sections that are similar in function to those of the first embodiment shown in FIG. 1 are designated by the same reference numerals. The description of them will not be repeated hereinafter. Moreover, the image of the digital broadcasting that is transmitted from the TV broadcasting station shall contain the telops being the static images, which are mixed in the moving image as shown in FIG. 2. The telops shall be displayed in at least one of the specific regions R201, R202, R203, R204 around the four corners of the display screen during most of broadcasting time.

In FIG. 5, an accumulated elapsed-time counter 102' is adapted to count the accumulated drive-time of the DPD 107 in lieu of the accumulated elapsed-time of the static image displaying. In the digital broadcasting in which the telop is displayed for much of the broadcasting time, this way is not practically a problem.

This embodiment is similar to the first embodiment except that whether or not the accumulated drive-time of the PDP 107 exceeds the accumulated elapsed-time TB is judged at the S301 in the flowchart of FIG. 4. The other processing will not be repeated.

The present invention is not limited to the above-mentioned embodiments. It is recognized, therefore, that various changes may be made to the above-mentioned invention without departing from the scope and spirit of this invention. While mainly the PDP display device is intensively discussed above, it is needless to say that this invention may also be applied to, for example, the FED (SED) display device or the like.

Moreover, the above-mentioned embodiments contain various inventions. By suitable combinations of the several elements disclosed herein, various inventions can be extracted. For example, even if some of the above-mentioned elements of the embodiments are omitted, one structure falls within the scope of the present invention as long as the structure can solve at least one of the problems of the prior art as discussed above and can obtain the effects of the present invention.

What is claimed is:

1. An image display device for displaying images, comprising:

a display section which displays an image of an input image signal on a display screen;

an image processing section which performs a luminance correction operation which lowers a luminance level of at least one predetermined region of the display screen relative to the luminance level of at least another predetermined region of the display screen if a static image is displayed on the at least one predetermined region of the display screen when the image of the input image signal is displayed on the display screen of the display section: and a control section which controls the image processing section;

wherein, when an accumulated elapsed-time of the static image, after initial lighting of the image display device, displayed on the at least one predetermined region of the display screen exceeds a predetermined time, the control section controls the image processing section so that the image processing section does not perform the luminance correction operation to lower the luminance level of the at least one predetermined region of the display screen even if the static image is displayed on the at least one predetermined region after the predetermined time, and wherein the predetermined time is a time when a luminance difference becomes equal to or less than a given value, the luminance difference indicating difference in luminance between the static image displaying part and the moving image displaying part when an entire white signal is displayed on the screen in both the static image displaying part and the moving image displaying part.

2. The image display device according to claim 1, wherein the static image is a time clock or a logo mark representing a service provider.

3. The image display device according to claim 1, wherein the at least one predetermined region of the display screen includes at least one of four corners of the display screen.

4. The image display device according to claim 1, wherein the at least another predetermined region of the display screen includes a center of the display screen.

5. The image display device according to claim 1, wherein the at least one predetermined region of the display screen includes at least one of four corners of the display screen, the at least another predetermined region of the display screen includes a center of the display screen, and wherein the image processing section lowers the luminance level of the at least one predetermined region of the display screen relative to the center of the display screen gradually along at least one direction from the center of the display screen to the at least one of four corners of the display screen.

6. The image display device according to claim 1, wherein the display section uses a display panel utilizing a light emission of an excited phosphor so as to display an image.

7. The image display device according to claim 6, wherein the display panel is a plasma display panel or a field emission display panel.

8. An image display device for displaying images, comprising:

a display section which displays an image of an input image signal on a display screen;

a static image detection section which detects a static image on at least one predetermined region of the display screen;

an image processing section which performs a luminance correction operation so as to lower a luminance level of the at least one predetermined region of the display screen relative to the luminance level of at least another region of the display screen when the image of the input image signal is displayed on the display screen of the display section; and a control section which controls the image processing section to perform the luminance correction operation when the static image is detected by the static image detection section on the at least one predetermined region of the display screen;

wherein, when an accumulated elapsed-time of the static image, after initial lighting of the image display device, displayed on the at least one predetermined region of the display screen exceeds a predetermined time, the control section controls the image processing section so that the image processing section does not perform the luminance correction operation to lower the luminance level of the at least one predetermined region of the display screen even if the static image is detected on the at least one predetermined region of the display screen by the static image detection section after the predetermined time, and wherein the predetermined time is a time when a luminance difference becomes equal to or less than a given value, the luminance difference indicating difference in luminance between the static image displaying part and the moving image displaying part when an entire white signal is displayed on the screen in both the static image displaying part and the moving image displaying part.

9. An image display device for displaying images, comprising:

a display section which displays an image of an input image signal on a display screen;

a static image detection section which detects a static image on at least one predetermined region of the display screen;

an image processing section which performs a luminance correction operation so as to lower a luminance level of the at least one predetermined region of the display screen relative to the luminance level of at least another region of the display screen when the image of the input image signal is displayed on the display screen of the display section; and a control section which controls the image processing section to perform the luminance correction operation when the static image is detected by the static image detection section on the at least one region of the display screen;

wherein, when an accumulated drive-time of the image display device, after initial lighting of the image display device, exceeds a predetermined time, the control section controls the image processing section so that the image processing section does not perform the luminance correction operation to lower the luminance level of the at least one predetermined region of the display screen even if the static image is detected on the at least one predetermined region of the display screen by the static image detection section after the predetermined time, wherein the predetermined time is a time when a luminance difference becomes equal to or less than a given value, the luminance difference indicating difference in luminance between the static image displaying part and the moving image displaying part when an entire white signal is displayed on the screen in both the static image displaying part and the moving image displaying part.

* * * * *